US008673438B2

(12) United States Patent
Soroushian et al.

(10) Patent No.: US 8,673,438 B2
(45) Date of Patent: Mar. 18, 2014

(54) SELF-HEALING AND ADAPTIVE SHAPED ARTICLES

(75) Inventors: Parviz Soroushian, Okemos, MI (US); Anagi Manjula Balachandra, Okemos, MI (US)

(73) Assignee: Metna Co.

( * ) Notice: Subject to any disclaimer, the term of this patent is extended or adjusted under 35 U.S.C. 154(b) by 1191 days.

(21) Appl. No.: 12/459,872

(22) Filed: Jul. 10, 2009

(65) Prior Publication Data

US 2010/0096257 A1 Apr. 22, 2010

Related U.S. Application Data

(63) Continuation-in-part of application No. 10/887,683, filed on Jul. 12, 2004, now abandoned.

(51) Int. Cl.

| | |
|---|---|
| ***B32B 15/08*** | (2006.01) |
| ***B32B 15/14*** | (2006.01) |
| ***B32B 27/12*** | (2006.01) |
| ***B32B 27/04*** | (2006.01) |
| ***B32B 9/00*** | (2006.01) |
| ***H01L 41/00*** | (2013.01) |

(52) U.S. Cl.
USPC ..... 428/301.1; 428/300.7; 428/300.1; 428/378; 428/380; 428/381; 428/389

(58) Field of Classification Search
USPC ..... 442/59–180; 428/357, 364, 375, 378, 428/402
See application file for complete search history.

(56) References Cited

U.S. PATENT DOCUMENTS

| | | | | |
|---|---|---|---|---|
| 4,200,701 | A * | 4/1980 | Wetton et al. | 528/44 |
| 4,599,256 | A | 7/1986 | Vasilos | |
| 4,933,230 | A * | 6/1990 | Card et al. | 442/178 |
| 5,738,664 | A | 4/1998 | Erskine et al. | |
| 5,790,304 | A | 8/1998 | Sanders et al. | |
| 5,965,266 | A | 10/1999 | Goujard et al. | |
| 6,518,330 | B2 | 2/2003 | White et al. | |
| 6,963,157 | B2 * | 11/2005 | Sato et al. | 310/367 |

* cited by examiner

*Primary Examiner* — Jennifer A Steele

(57) ABSTRACT

A solid electrolyte and a piezoelectric material are incorporated into composite shaped articles to provide them with self-healing and adaptive qualities. The piezoelectric constituent converts the mechanical energy concentrated in critical areas into electrical energy which, in turn, guides and drives electrolytic transport of mass within the solid electrolyte towards, and its electrodeposition at critical areas to render self-healing and adaptive effects.

4 Claims, 13 Drawing Sheets

Deposited Copper (a) (b) (c)

SELF-HEALING AND ADAPTIVE SHAPED ARTICLES

The present application is a Continuation of Parts of U.S. patent application Ser. No. 10/887,683, filed Jul. 12, 2004.

This invention was made with U.S. government support under Contract W911W6-04-C-0024 by U.S. Army. The U.S. government has certain rights in the invention.

BACKGROUND OF THE INVENTION

1. Field of the Invention

The invention is generally related to self-healing and adaptive materials. Particularly, the invention is directed to materials which can alter their internal mass distribution in response to stress gradients in order to optimally utilize the available structural substance in critical areas subjected to stress and temperature rise.

2. Description of the Relevant Art

Altering service environments as well as damaging effects change the stress distribution within structures. Biological systems such as bone are capable of adapting to changes in stress distribution through transport of substance towards and its deposition at highly stressed areas. This adaptive/self-healing capability enables biological structural systems make optimal use of available materials as new circumstances evolve. Various efforts have been made to develop synthetic materials which mimic the self-healing/adaptive qualities of biological systems.

U.S. Pat. No. 6,518,330 discloses a self-healing material with the polymeric healing agent stored in microspheres which are dispersed within the material systems. Damage (cracking) of the material would cause breakage of the microspheres and release of the healing agent, which fills the crack and rebonds the crack faces. U.S. Pat. No. 5,790,304 discloses self-healing coatings incorporating sacrificial constituents which react with oxygen at defects (e.g., cracks and voids) to produce compounds which condense on such defects and thereby restore the integrity of coating. U.S. Pat. No. 5,965,266 discloses a self-healing high-temperature materials incorporating constituents capable of reacting with oxygen to produce compounds to plug cracks and mitigate access of oxygen to the core of the material. U.S. Pat. No. 4,599,256 discloses a high-temperature material incorporating multiple constituents which, when exposed to the elevated service temperature at cracks, react with each other to produce compounds which seal the cracks. U.S. Pat. No. 5,738,664 discloses a material incorporating a viscous flowable constituent which can flow into defects to restore the integrity of the material.

The above inventions rely on damaging effects (e.g., cracks) to either release the healing agent or to promote chemical reactions (e.g., upon exposure to oxygen) which render self-healing and adaptive effects. Unlike the invention described herein, they do not rely on electrolytic mass transport to strengthen highly stressed areas, and they do not convert the destructive mechanical energy concentrated in critical areas to electrical potential and energy which guide and drive the self-healing/adaptive effects.

SUMMARY OF THE INVENTION

It is an object of this invention to provide solid material systems within which substance can be transported for an optimum mass distribution to be realized.

It is another object of this invention to convert the destructive mechanical energy concentrated within critical areas of the material into the electrical energy needed to drive the mass transport phenomenon.

It is another object of this invention to convert the stress gradients within the material into the electric potential which guides transport of mass towards critical areas.

It is another object of this invention to integrate the energy conversion and mass transport capabilities into a material system which is inherently capable of transporting substance towards critical areas to render self-healing and adaptive effects.

Applicant has discovered that electrolytic transport and electrodeposition of mass within solid electrolytes can strengthen and densify areas within which electrodeposition has taken place. Applicant has also discovered that the piezoelectric effect can generate sufficient electric potential and energy, by conversion of mechanical energy, to drive and guide electrolytic mass transport within solid electrolyte.

According to the invention, there is provided composite materials comprising a solid electrolyte, a dissolved metal salt, and a piezoelectric material, which can strengthen and densify highly stressed areas through electrolytic mass transport and electrodeposition.

DETAILED DESCRIPTION OF THE PREFERRED EMBODIMENTS OF THE INVENTION

Figure 1:
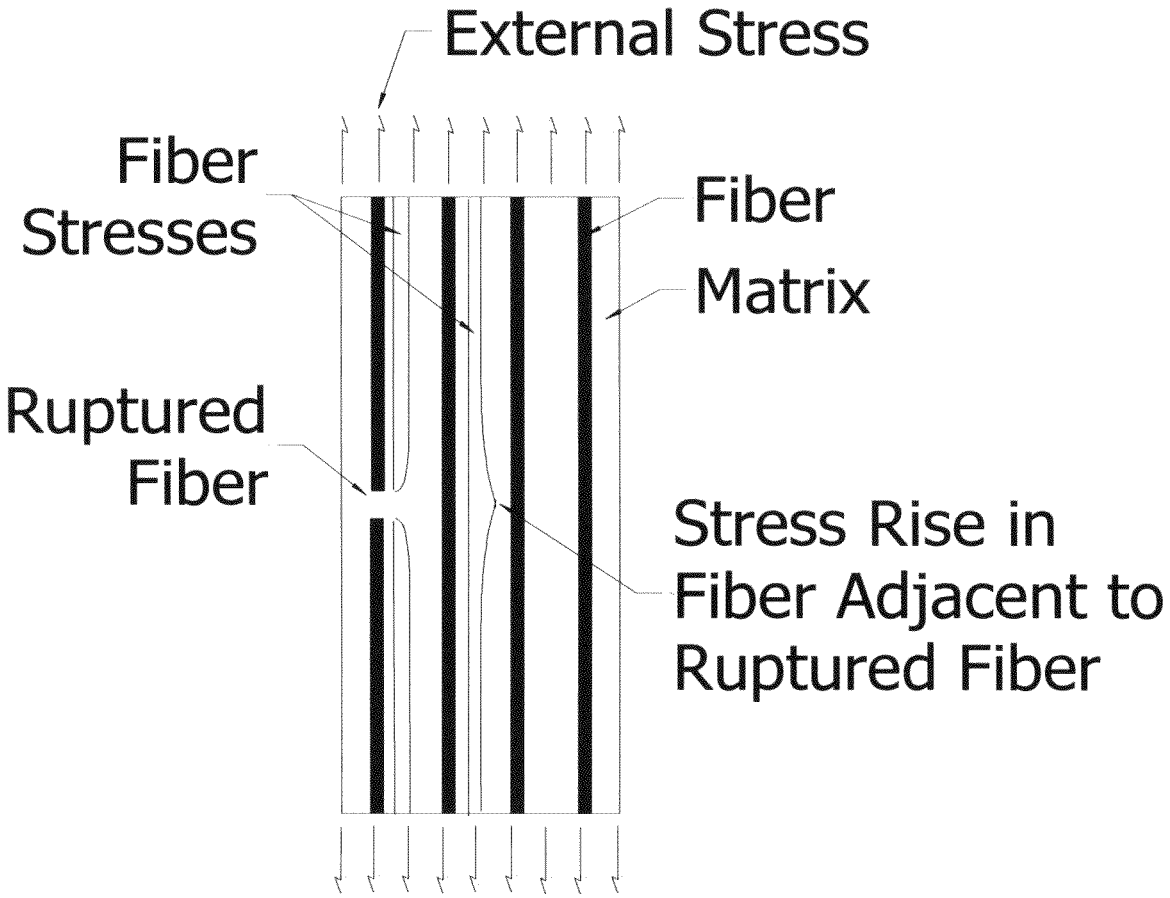
FIG. 1 shows a fiber reinforced composite under stress, where rupture of one fiber has caused local stress rise in an adjacent fiber.

Damaging effects, changes in service environment and manufacturing defects modify the stress distribution which develops within materials, with local stress rise occurring in critical areas which govern the eventual failure. This invention concerns composite shaped articles that can optimally utilize their available material resources through partial transport of these resources towards critical areas which experience local stress rise, where the increased material concentration can render strengthening and densification effects to mitigate the initiation or propagation of damage.

Solid electrolytes are solids which can dissolve metal salts. Solid electrolytes are at least one of inorganic, organic and composite ion-conducting materials. Electrolytic phenomena can occur within solid electrolytes, and can be used to transport structural substance towards and to deposit it at particular locations in order to strengthen such locations. The structural substance is present in solid electrolyte in the form of dissolved salt; additional structural substance can be introduced in the form of metals which are in contact with the solid electrolyte. Solid electrolytes comprise at least one of poly (vinylidine fluoride-co-hexafluoropropylene), poly(vinylidine fluoride), polypyrrole, poly(ethylene oxide), poly(ethylene oxide methacrylate)-b-poly(lauryl methacrylate), Poly (propylene oxide), polyvinyl butyral, polyurethane, polystyrene sulfonate, poly(epichlorohydrin ethylene oxide), hydroxyethylcellulose grafted with poly(ethylene oxide)diisocyanate, carboxymethylcellulose grafted with poly(ethylene oxide)diisocyanate, polypyrrole/polysulfide blends, polypyrrole/polyetherimide blends, polyaniline/polyaniline-sulfuric acid blends, perfluorinated polymers, sulfonated polyetheretherketone, poly(acrylonitrile-co-methylmethacrylate), and polyethylene glycol.

Dissolved metal salt can be one of the following copper(II) trifluoromethane sulfonate, $AgNO_3$, $CuCl_2$, $Mg(ClO_4)_2$, aluminum chloride, boron trifluoride, zinc chloride, nickel chloride, nickel bromide, nickel iodide, nickel acetylacetonate, palladium chloride, palladium bromide, palladium iodide, iron chloride, iron bromide, iron iodide, cobalt chloride, cobalt bromide and cobalt iodide.

The electrolysis phenomena within solid electrolyte can be guided and driven by the piezoelectric effect. Piezoelectric materials generate electric potential and charge under stress gradient. If piezoelectric materials are in proper contact with a solid electrolyte, the electric potential resulting from stress gradients can guide, and the corresponding electric charge can drive electrolytic phenomena within the solid electrolyte to transport structural substance towards and deposit it at critical areas experiencing stress rise. The piezoelectric materials used in the embodiment consist of at least one of lead zirconate titanate ($Pb[Zr_xTi_{1-x}]O_3$ $0 \leq x \leq 1$)—more commonly known as PZT, barium titanate ($BaTiO_3$), berlinite ($AlPO_4$), quartz ($SiO_2$), potassium sodium tartrate ($KNaC_4H_4O_6.4H_2O$), topaz $Al_2SiO_4(F,OH)_2$, gallium orthophosphate ($GaPO_4$), Langasite ($La_3Ga_5SiO_{14}$), lead titanate ($PbTiO_3$), potassium niobate ($KNbO_3$), lithium niobate ($LiNbO_3$), lithium tantalate ($LiTaO_3$), sodium tungstate ($Na_2WO_3$), $Ba_2NaNb_5O_5$, $Pb_2KNb_5O_{15}$, polyvinylidene fluoride (PVDF), sodium potassium niobate ($(K, Na)NbO_3$) and bismuth ferrite ($BiFeO_3$).

The combination of solid electrolyte with a piezoelectric material, optional structural materials, and optional metal fillers, can thus be used to develop material systems which can partially adapt their internal mass distribution to internal stress systems which are altered by at least one of damaging effects, changing service environments, and manufacturing defects.

An optional structural material is consisting of at least one of polymer, ceramic and carbon materials.

Optional metal fillers and fibers are made of at least one of copper, zinc, nickel, silver, magnesium, palladium, iron, aluminum, cobalt and boron, the optional metal fillers are particles with dimensions ranging from 1 nanometer to 5 millimeter, and the optional metal fibers have diameters ranging from 1 nanometer to 1 millimeter.

Material systems comprising solid electrolyte in which metal salts are dissolved, salt, piezoelectric material and optionally other constituents can assume different configurations. One configuration introduces the solid electrolyte and the piezoelectric constituents as a multilayer coating system on reinforcing fibers in composites. Wherein, piezoelectric layer of 1 nanometer to 1 millimeter is coated on the reinforcing fiber (structural fiber) with diameters ranging from 1 nanometer to 1 millimeter. Solid electrolyte layer (in which metal salts are dissolved) with thickness ranging from 1 nanometer to 1 millimeter is coated on top of the piezoelectric layer on the reinforcing fiber. The coated structural fibers are embedded in a structural matrix comprising optional structural materials in the form of at least one of fibers with diameters ranging from 1 nanometer to 1 millimeter and fillers with dimensions ranging from 1 nanometer to 1 millimeter (FIGS. 2 and 3).

Figure 5:
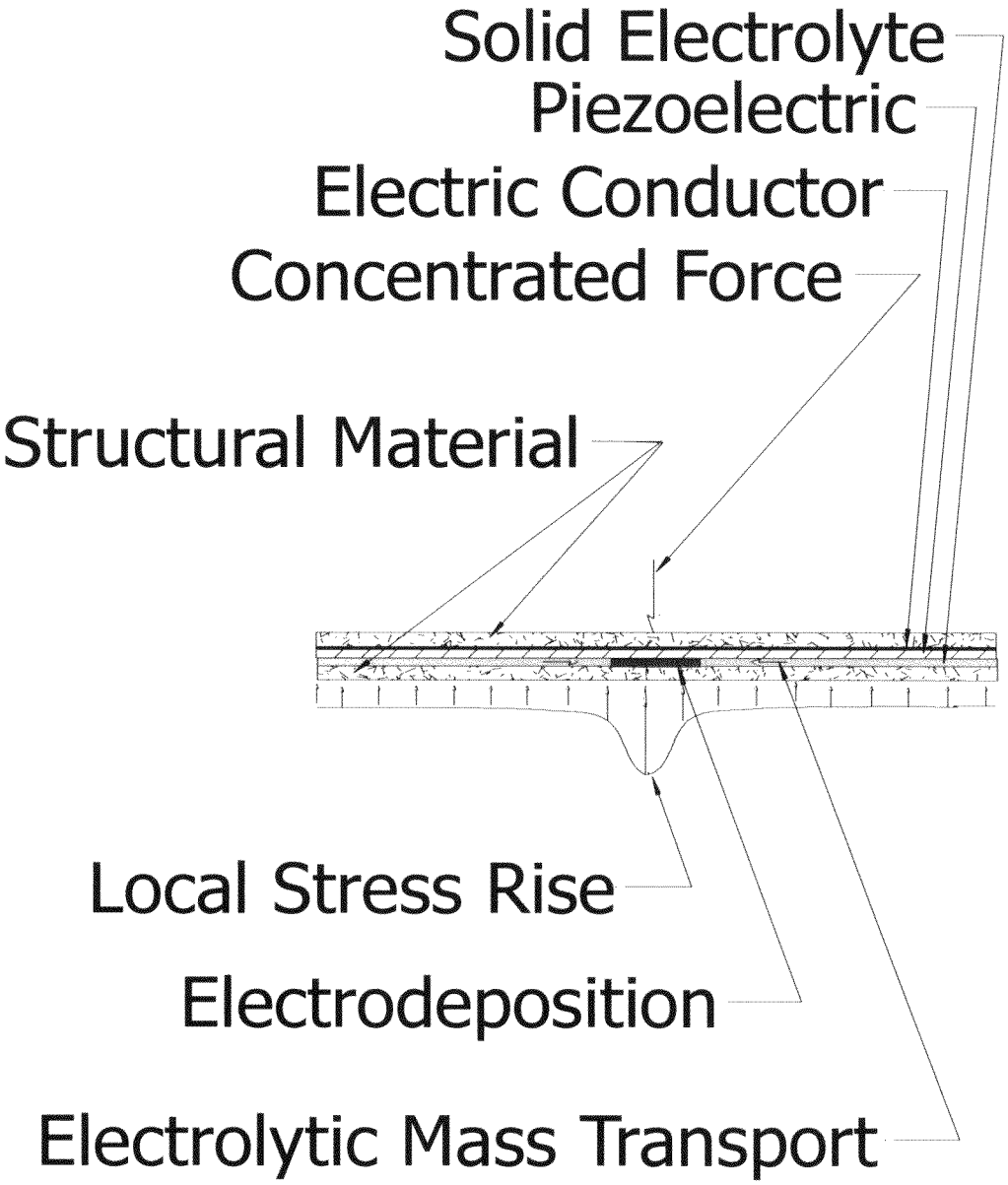
FIG. 5 shows a layered composite incorporating piezoelectric, solid electrolyte, conductive and structural layers, experiencing a local stress rise under concentrated force, with piezo-driven electrolytic mass transport and deposition strengthening the highly stressed area where the concentrated force is applied.
Figure 6:
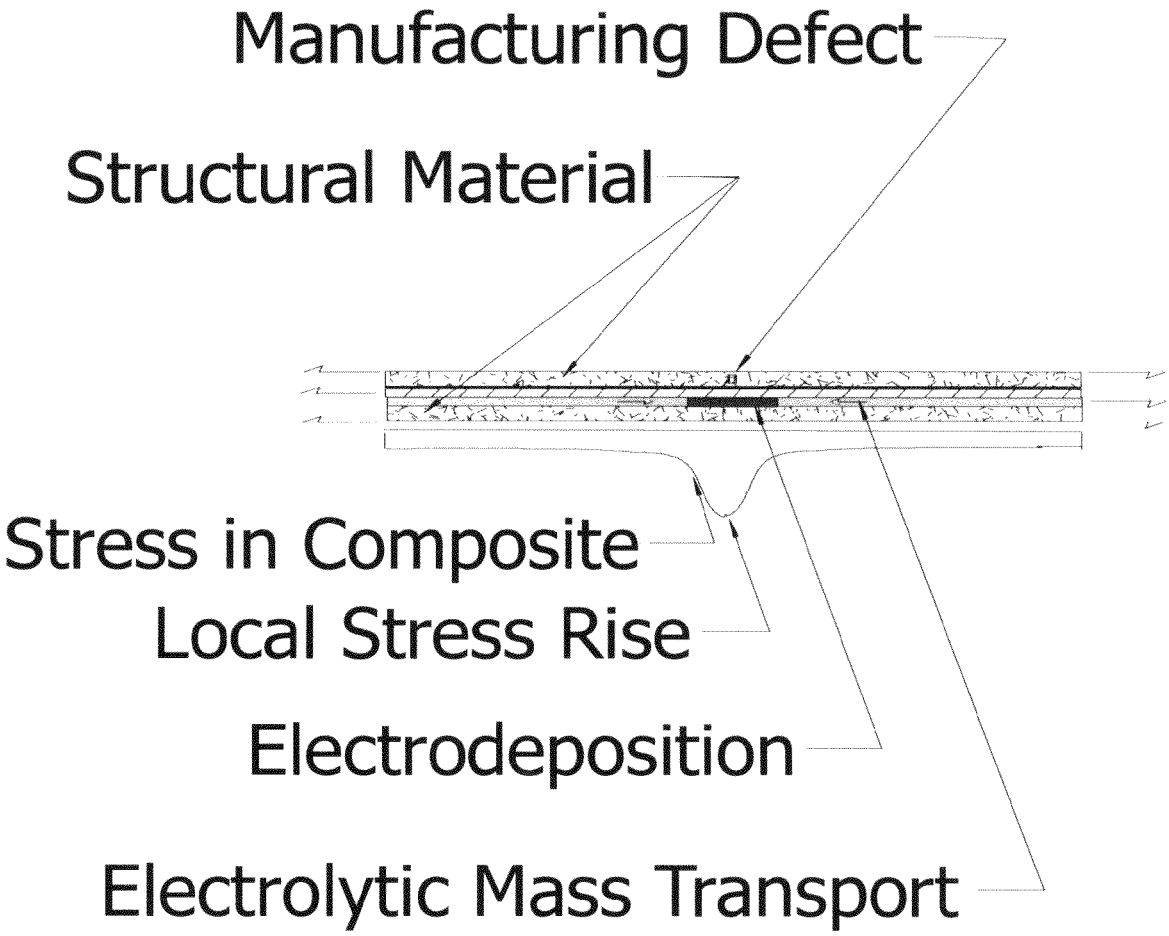
FIG. 6 shows a layered composite incorporating piezoelectric, solid electrolyte, conductive and structural layers, experiencing a local stress rise due to the presence of a manufacturing defect, with piezo-driven electrolytic mass transport and deposition strengthening the highly stressed area around the manufacturing defect.
Figure 7:
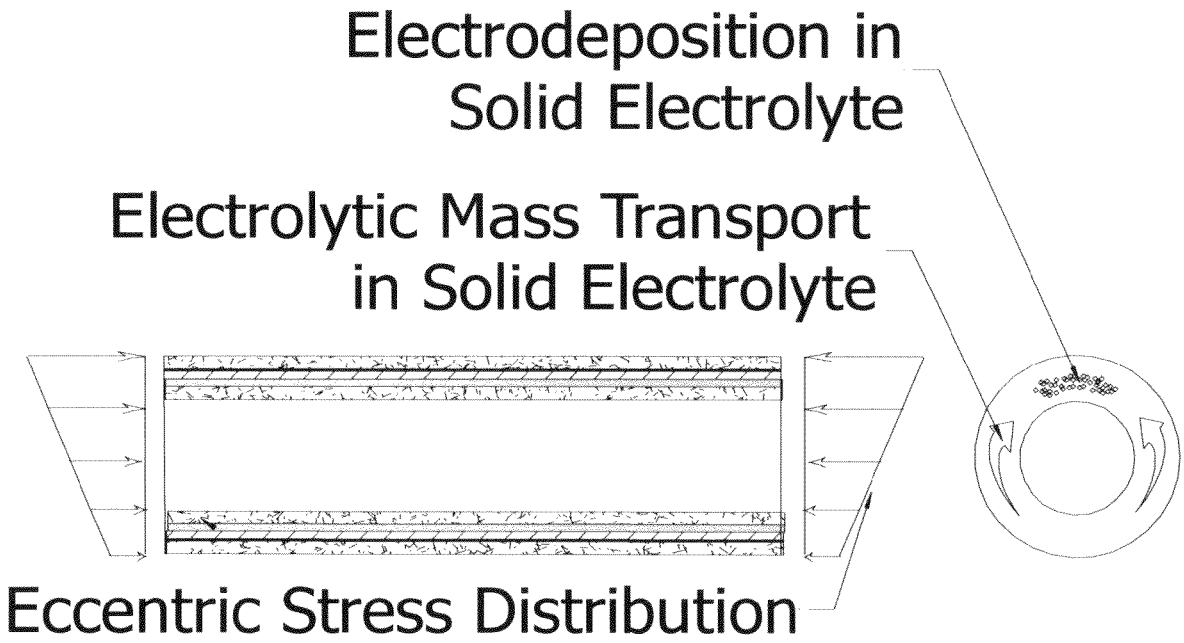
FIG. 7 shows a cylindrical structural element, made of a layered composite incorporating piezoelectric, solid electrolyte conductive and structural layers, subjected to a gradient stress system, with piezo-driven electrolytic mass transport and deposition strengthening regions within the structural element which are subjected to higher stress levels.

One other configuration is in the form of layered composites comprising solid electrolyte layer comprising electrolyte and dissolved metal salt with thickness ranging from 1 nanometer to 5 millimeter that is bonded to at least one piezoelectric layer with thickness ranging from 1 nanometer to 5 millimeter, at least one structural layer bonded to the piezoelectric layer with thickness ranging from 1 nanometer to 5 millimeter, and optionally at least one of metal fillers and fibers incorporated into at least one of said layers. Where in optional metal fillers and fibers provide a conductive layer (FIGS. 5-7).

Figure 2:
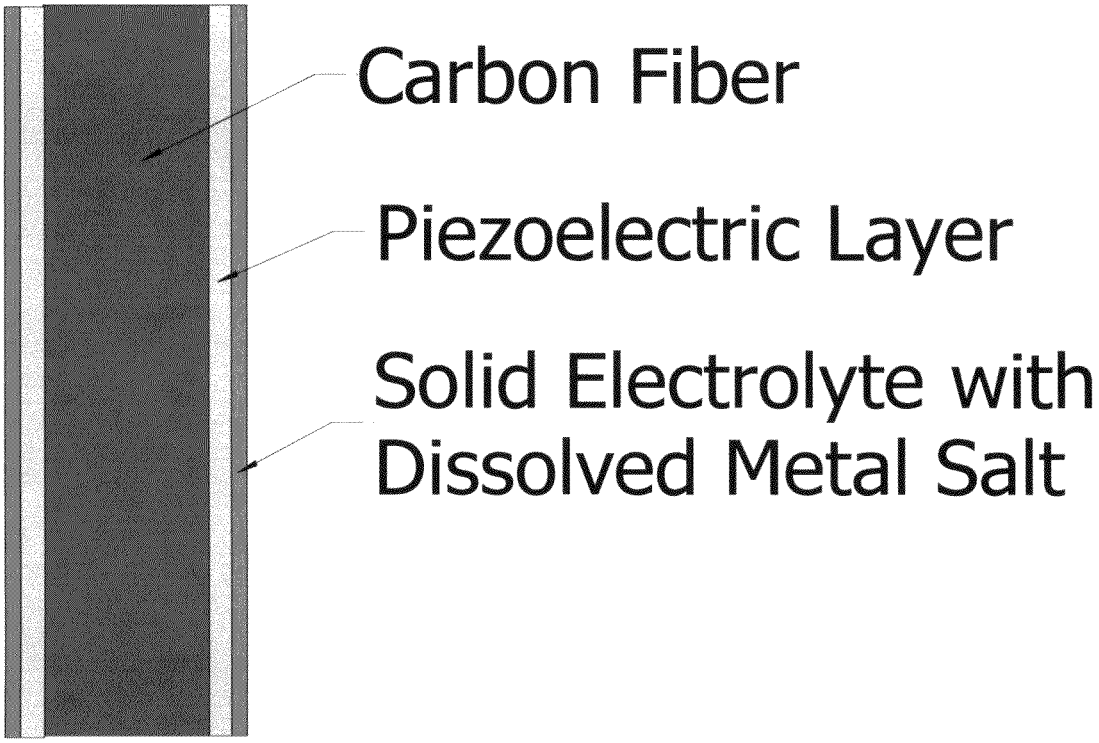
FIG. 2 shows a carbon fiber which has received a hybrid coating comprising a piezoelectric layer and a solid electrolyte layer with dissolved metal salt.
Figure 3:
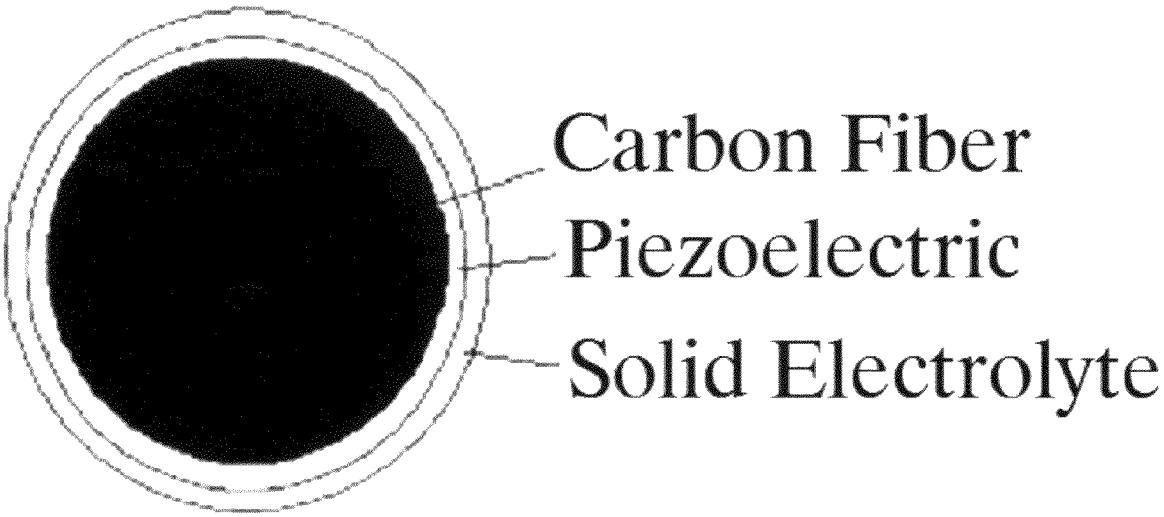
FIG. 3 shows the cross-section of the carbon fiber which has received a hybrid coating comprising a piezoelectric layer and a solid electrolyte layer (with dissolved metal salt).
Figure 4:
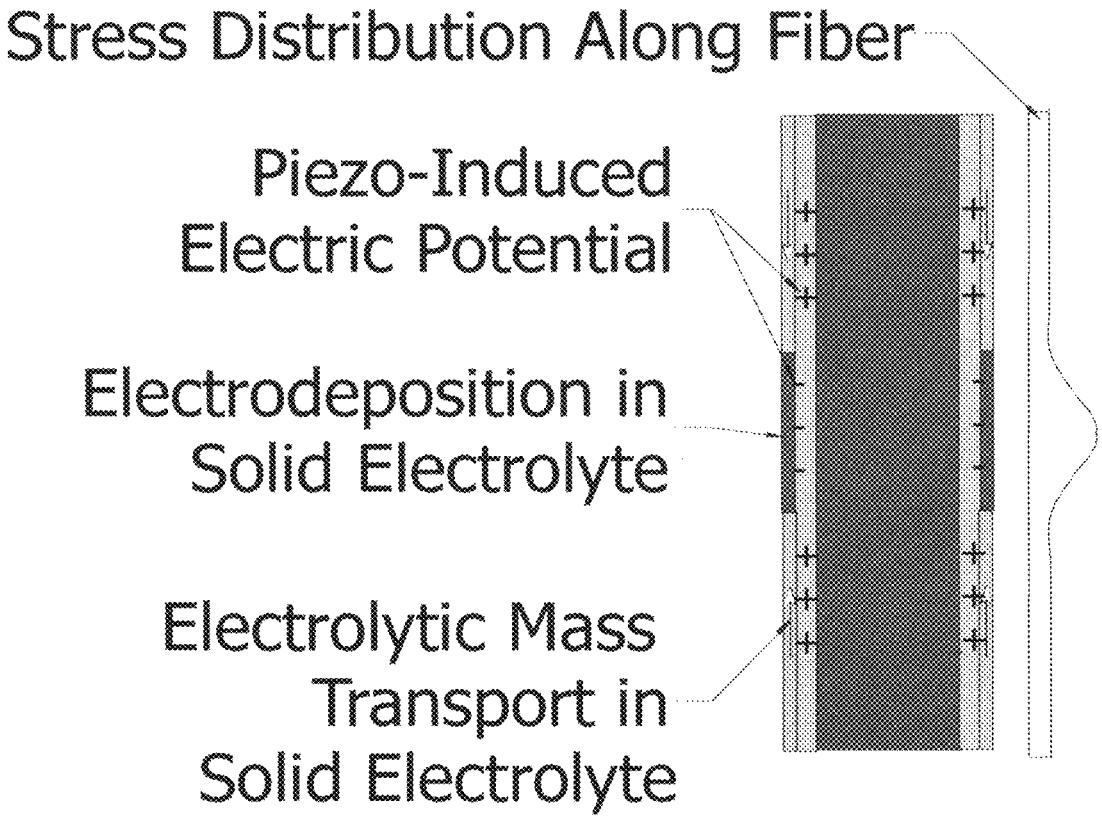
FIG. 4 shows a carbon fiber with piezoelectric and solid electrolyte coating layers where local stress rise within fiber has prompted piezo-induced electric potential difference along the fiber surface which, in turn, drives electrolytic phenomena within the solid electrolyte layer which transport mass towards and electrodeposit it at the highly stressed area.

FIGS. 1 through 4 present the example configuration where the piezoelectric and solid electrolyte constituents are introduced as a hybrid coating on reinforcing fibers in a composite system. FIG. 1 shows a fiber reinforced composite comprising reinforcing fibers and the matrix subjected to external stress; rupture of one fiber is shown to cause local stress rise in an adjacent fiber. FIG. 2 shows a length segment of a carbon fiber that has received a hybrid coating comprising a piezoelectric layer and a solid electrolyte layer with dissolved metal salt. FIG. 3 shows the cross section of the carbon fiber which has received the piezoelectric and solid electrolyte coating layers. FIG. 4 shows the same fiber as in FIGS. 2 and 3 subjected to local stress rise along its length. The stress gradient in piezoelectric material produces electric potential on the surface of the piezoelectric layer which is in contact with the solid electrolyte. This electric potential drives electrolytic transport of metal cations within the solid electrolyte and their electrodeposition at the highly stressed location along the fiber length. This electrodeposition strengthens the fiber at the highly stressed location where fiber rupture could otherwise occur. This process of mass transport towards and its deposition at the highly stressed location would, in the configuration of FIG. 1, strengthen the damaged zone of the composite material where fiber rupture has occurred, and could thus mitigate the propagation of an otherwise catastrophic failure process.

FIGS. 1 through 4 are manifestations of the self-healing features of the invention. FIG. 5 depicts the adaptive features of the invention in an example where the piezoelectric and solid electrolyte constituents are introduced as layers within a laminated structural material. Application of a concentrated force in this example, with the laminated composite placed on a flat surface, causes a local stress rise which drives electrolytic mass transport and electrodeposition phenomena to strengthen the highly stressed region under the concentrated force. FIG. 6 presents the laminated composite of FIG. 5 subjected to tensile stress, where a local stress rise is caused by a manufacturing defect, and the electrolytic mass transport and electrodeposition phenomena strengthen the critical area around the defect. FIG. 7 presents a cylindrical element made of a laminated composite similar to that presented in FIG. 5, with an eccentric load generating an unsymmetric stress distribution; electrolytic mass transport and electrodeposition phenomena in this case tend to normalize the stress distribution and approach an optimum use of structural materials.

INVENTION AND COMPARISON EXAMPLES

Example 1

Solid electrolytes were prepared with dissolved metal salt, without and with fine copper filler. Electrolysis phenomena occurring in the context of a solid electrolyte, causing electrodeposition of metal at cathode, were verified experimentally.

Materials

Poly(acrylonitrile) (PAN, $M_w$=86,200), ethylene carbonate (EC, 98%), propylene carbonate (PC, 99%), copper (II) trifluoromethanesulfonate (CuTf, 98%), copper filler (3 micron, dendritic, 99.7%), and acetonitrile (99.93%+, HPLC grade) were purchased from Aldrich, and were used without any further purification. The use of copper slat in this investigation implies that copper is the metal to be ionically transported and electrodeposited to render self-healing effects. A variety of other metals (nickel, etc.) can replace copper in the process.

Preparation of Solid Electrolyte without Copper Filler

PAN (1.06 g or 20 mole %), EC (3.6 g or 41 mole %) and CuTf (1.8 g or 5 mole %) were weighed into a ceramic crucible and mixed well before adding PC (3.4 g or 34 mole %). PC was then added, and the blend was stirred until thorough dissolution and a mixture of uniform light blue color was obtained. The mixture was then heated to 120° C. and maintained at this temperature for 45 minutes (using a temperature-programmed oven with heating rate of 20° C./min, and total heating duration of 51 minutes). The mixture was allowed to cool down to room temperature, and was then vacuum dried for 24 hours, and further dried at 60° C. under vacuum for 2 hours. The end product was light green in color, and it was pressed to yield the test specimen.

Preparation of Solid Electrolyte with Copper Filler

The copper salt dissolved in solid electrolyte can act as the source of metallic ion to be transported and deposited for self-healing effects. In addition, one can add copper fillers to raise the quantity of metal available to render self-healing effects. In order to prepare the PAN-based solid electrolyte incorporating copper filler, first PAN, EC and CuTf were weighed in a ceramic crucible, and mixed well before adding PC. PC was then added, and the mix was magnetically stirred until thorough dissolution (a uniform mixture) was achieved after about 1 hour. Different amounts of copper particles were then added to the mix and magnetically stirred until a mixture with uniform light brown/blue color was obtained; the intensity of brown color depended on the dosage of copper filler. The mixture incorporated 1.0 g of water for 10% filler content. The remaining steps in synthesis and pressing of solid electrolyte specimens with copper filler were similar to those taken for the specimen without filler.

Experimental Procedure

Figure 8:
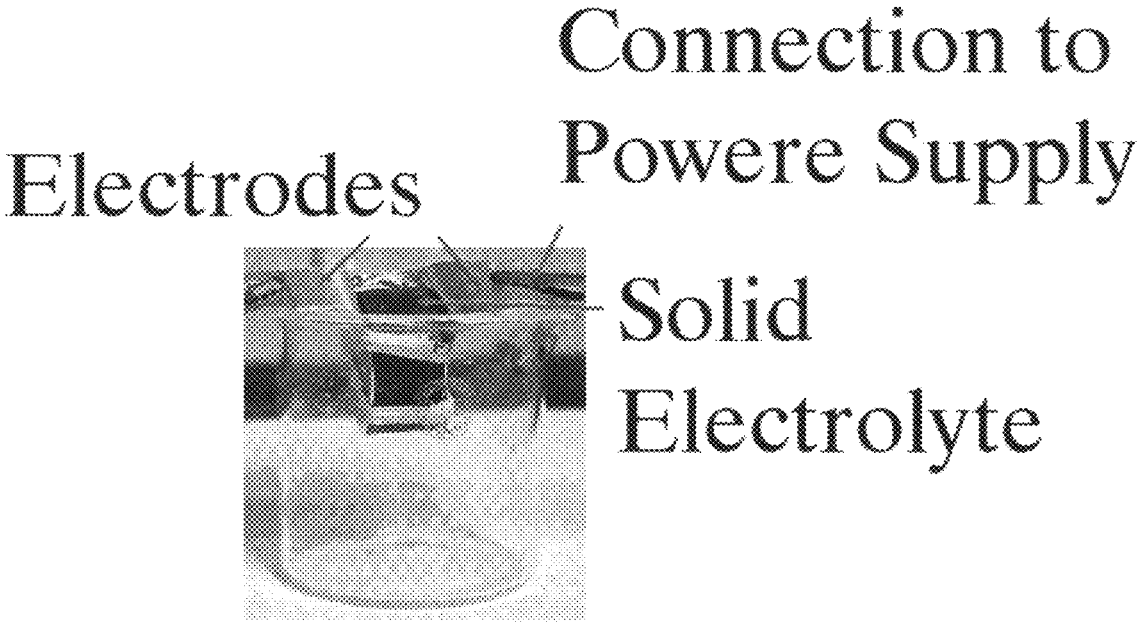
FIG. 8 shows the solid electrolyte specimen sandwiched between two aluminum electrodes which are connected to a DC power supply.

The solid electrolyte was tightly sandwiched between two aluminum electrodes, as shown in FIG. 8, and a constant voltage was applied for a period of three days. After three days, the aluminum electrodes at anode and cathode were inspected visually.

Test Results and Discussion

Figure 9:
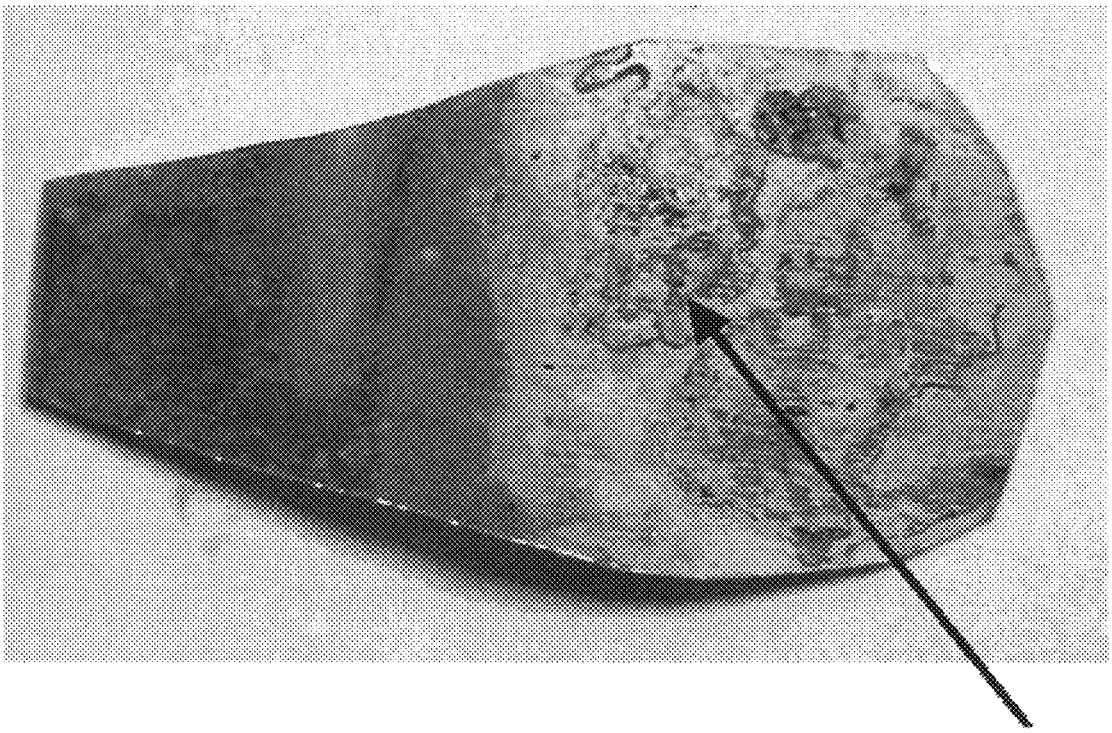
FIG. 9 shows the cathode electrode where electrodeposition of copper has taken place for the case with solid electrolyte incorporating dissolved copper salt but no copper filler.
Figure 10:
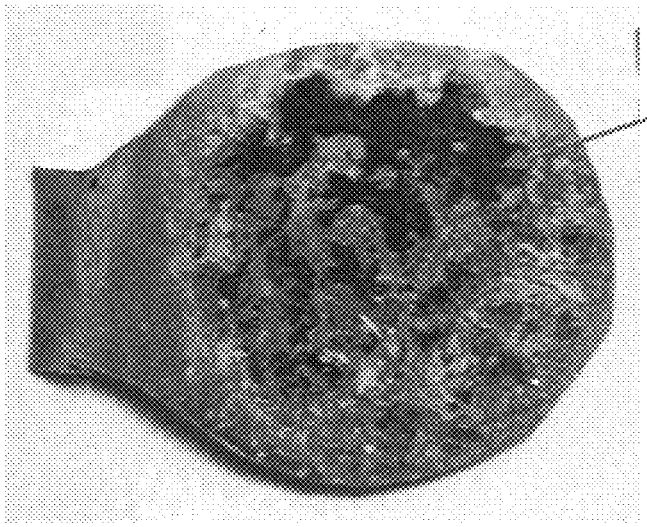
FIG. 10 shows the cathode electrode where electrodeposition of copper has taken place for the case with solid electrolyte incorporating both dissolved copper salt and copper filler.

Since the solid electrolyte has some copper salt dissolved in it, even with no copper filler added to the solid electrolyte, indications of electrodeposition of copper was observed to occur on the aluminum sheet at cathode, as shown in FIG. 9, with no such deposition observed at anode. Copper fillers were added to the PAN-based solid electrolyte to complement the dissolved metal salt as the source of metal for electrolysis processes which render self-healing effects. In the case of solid electrolyte with metallic filler, dispersed copper fillers as well as the dissolve copper salt were the sources of copper for the electrolysis process. FIG. 10 shows the aluminum sheet surface at cathode after application of constant voltage. Electrodeposition of copper on aluminum sheet at cathode is apparent in FIG. 10, with no such deposition observed at anode.

Example 2

Materials

The materials used for preparation of PVDF-HFP solid electrolyte included poly(vinylidine fluoride-co-hexafluoropropylene) (PVDF-HFP) (pellets, crystalline copolymer, 15% HFP, average $M_w$~400,000), ethylene carbonate (EC, 98%), propylene carbonate (PC, 99%), copper (II) trifluoromethanesulfonate (CuTf, 98%), and tetrahydrofuran (THF, 99.9+HPLC grade, inhibitor free). The electrodes were made of 50 micron thick stainless steel shims. The copper salt was used in this verification study as an example; other metal salts could replace the copper salt to yield self-healing and adaptive effects by deposition of metals with higher performance-to-weight rations than copper.

Two different solid electrolytes were prepared by varying the proportions of copper salt, EC and PC while keeping the PVDF-HFP percentage constant. In order to prepare the solid polymer electrolyte with 3% copper ion concentration, PVDF-HFP was dissolved in THF (30% by weight, 3 g) at 60° C. Subsequently, CuTf (1.8084 g), EC (3.5224 g) and PC (1.7865 g) were added to the mix (70% by weight at CuTf: EC: PC ratios of 1.0:8.0:3.5), and dissolved until a uniform solution was obtained. The solution was cast on a Petri dish, and left at room temperature until all the THF was evaporated. A free standing polymer sheet of blue/green color was obtained, which was cut into pieces for use in electrochemical experiments. Since the most common coordination number of copper is four, each copper ion will bind with four fluorine atoms. This defines the maximum copper ion-to-polymer molar ratio of 2, which guides our efforts to increase the concentration of copper ions in PVDF-HFP.

In order to prepare the solid polymer electrolyte with 6% copper ion concentration, PVDF-HFP was dissolved in THF (30% by weight, 3 g) at 60° C. Subsequently, CuTf (3.6168 g), EC (1.7612 g) and PC (0.89325 g) were added to the mix (70% by weight at CuTf plus EC plus PC), and dissolved until a uniform solution was obtained. The solution was cast on a Petri dish, and left at room temperature until all the THF was evaporated. A free standing polymer sheet of blue/green color was obtained, which was cut into pieces for use in electrochemical experiments. Since the most common coordination number of copper is four, each copper ion will bind with four fluorine atoms. This defines the maximum copper ion-to-polymer molar ratio of 2, which guides efforts to increase the concentration of copper ions in PVDF-HFP.

Experimental Procedures

Figure 11:
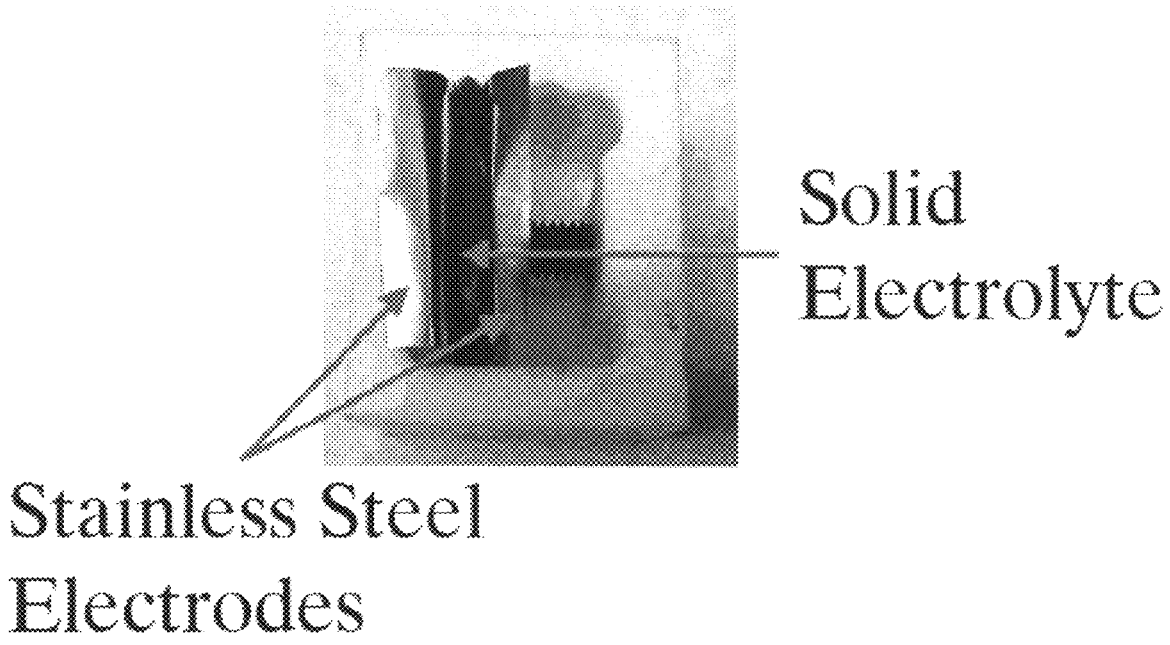
FIG. 11 shows the electrolysis cell comprising a solid electrolyte sheet sandwiched between two stainless steel electrodes.
Figure 12:
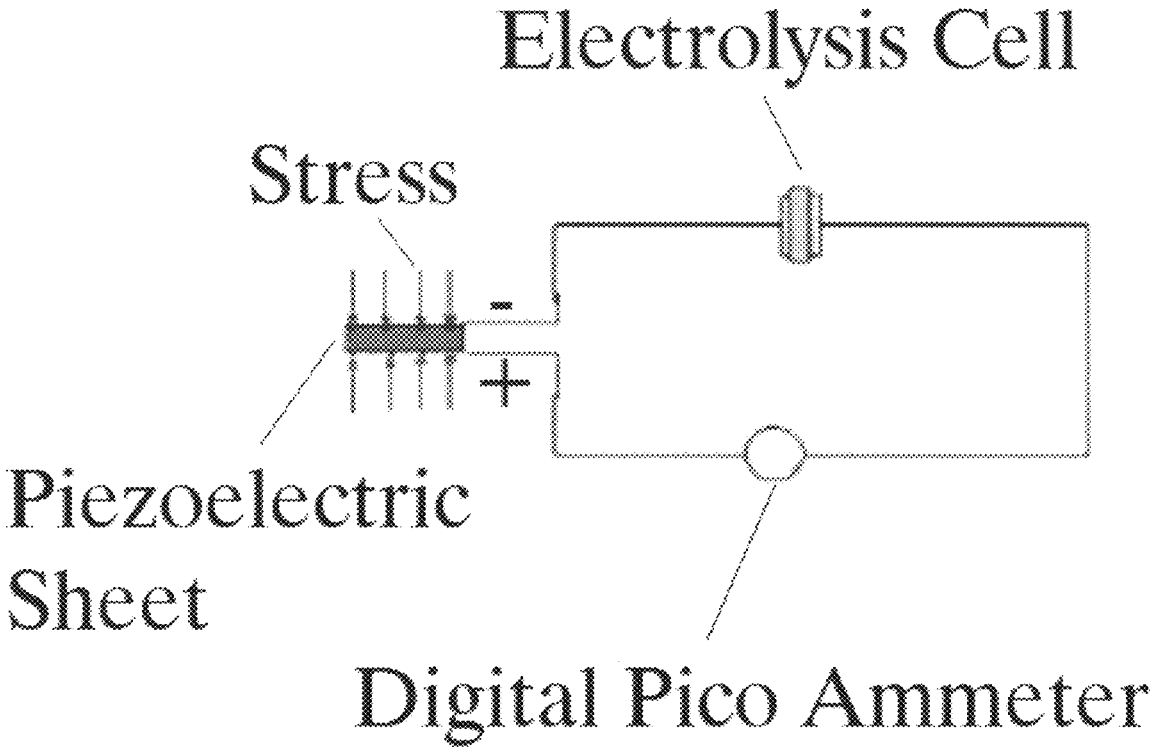
FIG. 12 shows a piezo-driven electrolysis test set-up where a piezoelectric sheet is subjected to stress in order to generate the electric potential and charge needed to drive electrolysis phenomena within a solid electrolyte.

In order to validate piezo-induced electrolysis within solid electrolyte, PVDF-HFP specimens with dissolve copper salt was sandwiched between two stainless steel electrodes, as shown in FIG. 11. Piezoelectric (PZT fiber reinforced composite) sheets were then subjected to repeated stress application, as shown schematically in FIG. 12, and the piezo-induced voltage was applied between the electrodes. Current was measured at pico amp precision (between the piezo-setup and electrodes). The basic elements of the test set-up are depicted in FIG. 11. The current flowing through the solid electrolyte was found to be 20 μA; a load frequency of 3 Hz was used in this experiment which lasted 18 hours. After this period, the solid electrolyte surfaces at anode and cathode were inspected visually, and were subjected to hardness tests (ASTM D 2240) in order to assess any changes in mechanical attributes associated with electrolytic mass transport and deposition.

Experimental Results

Figure 13:
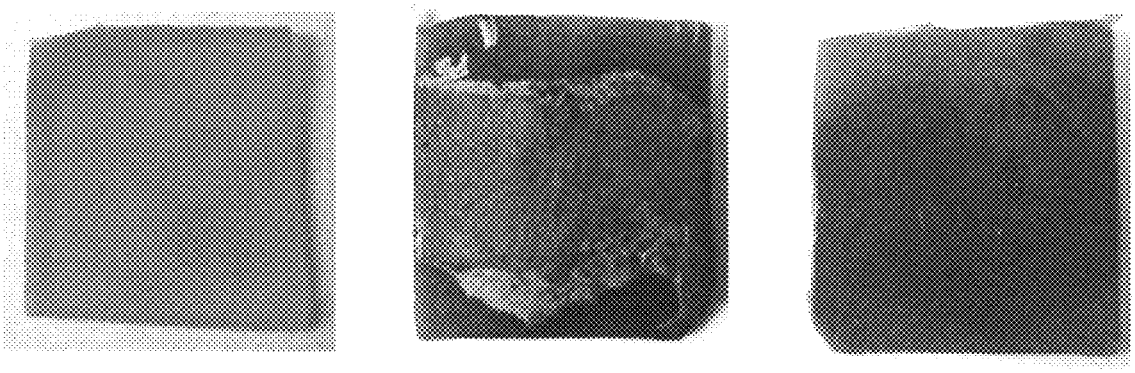
FIG. 13 shows: (a) solid electrolyte sheet (with dissolved metal salt) prior to piezo-driven electrolysis; (b) the cathode face of the solid electrolyte sheet after piezo-driven electrolysis, where electrodeposition has taken place; and (c) the anode face of the solid electrolyte sheet after piezo-driven electrolysis.

The experimental results provided clear evidence of metal deposition at cathode interface under piezo-driven electrolysis in solid electrolyte. FIG. 13*a* shows the solid electrolyte with dissolved metal salt prior to piezo-driven electrolysis. Observation of the cathode and anode interfaces of the solid electrolyte after the test, shown in FIGS. 13*b* and 13*c*, respectively, provided clear evidenced for piezo-driven electrolysis at cathode. After piezo-driven electrolysis, the solid electrolyte adhered to the electrode at cathode. The hardness values at anode and cathode after piezo-driven electrolytic mass transport and deposition were 33.3 and 48.1 Shore A (ASTM D 2240), respectively, compared with a hardness value of 34.0 Shore A (ASTM D 2240) for the solid electrolyte prior to piezo-driven electrolysis. The results indicate more than 40% gain in hardness (representing mechanical attributes) at cathode where electrodeposition has taken place, confirming the gain in mechanical properties at cathode associated with piezo-driven electrolysis within solid electrolyte. On the other hand, anode experiences only about 2% loss of hardness, indicating that the local gains in mechanical performance at cathode are achieved through piezo-driven electrolysis without any major loss of mechanical performance elsewhere.

I claim:

1. The self-healing and adaptive shaped articles are in the form of fiber reinforced composites comprising structural fibers with diameters ranging from 1 nanometer to 1 millimeter, said structural fibers coated with piezoelectric materials with thickness ranging from 1 nanometer to 1 millimeter to form a coated structural fiber, and applied upon said coated piezoelectric material, solid electrolyte materials with thickness ranging from 1 nanometer to 1 millimeter, wherein the solid electrolyte materials comprise at least one solid electrolyte and at least one dissolved metal salt, the coated structural fibers are embedded in a structural matrix, wherein gradient stress distributions indicate development of critical areas with elevated stress levels induce, by the piezoelectric effect, gradient electric potentials which transport metal towards and deposit it at said critical areas by electrolytic processes within the solid electrolyte, rendering self-healing and adaptive effects and;

wherein said piezoelectric materials comprise at least one of lead zirconate titanate ($Pb[Zr_xTi_{1-x}]O_3$ 0<x>1) more commonly known as PZT, barium titanate ($BaTiO_3$), berlinite ($AlPO_4$), quartz ($SiO_2$), potassium sodium tartrate (KNaC4H406*4$H_2O$), topaz $Al_2SiO_4(F,OH)_2$, gallium orthophosphate ($GaPO_4$), Langasite ($La_3Ga_5SiO_{14}$), lead titanate ($PbTiO_3$), potassium niobate ($KNbO_3$), lithium niobate ($LiNbO_3$), lithium tantalate ($LiTaO_3$), sodium tungstate ($Na_2WO_3$), $Ba_2NaNb_5O_5$, $Pb_2KNb_5O_{15}$, polyvinylidene fluoride (PVDF), sodium potassium niobate ((K, Na)$NbO_3$) and bismuth ferrite ($BiFeO_3$);

wherein said solid electrolytes comprise at least one of poly(vinylidine fluoride-co-hexafluoropropylene), poly (vinylidine fluoride), polypyrrole, poly(ethylene oxide), poly(ethylene oxide methacrylate)-b-poly(lauryl methacrylate), poly(propylene oxide), polyvinyl butyral, polyurethane, polystyrene sulfonate, poly(epichlorohydrin ethylene oxide), hydroxyethyl cellulose grafted with poly(ethylene oxide)diisocyanate, carboxymethylcellulose grafted with poly(ethylene oxide)diisocyanate, polypyrrole/polysulfide blends, polypyrrole/polyetherimide blends, polyaniline/polyaniline-sulfuric acid blends, perfluorinated polymers, sulfonated polyetheretherketone, poly(acrylonitrile), poly(acrylonitrile-co-methylmethacrylate), and polyethylene glycol and;

wherein said dissolved metal salts comprise at least one of copper(II) trifluoromethane sulfonate, $AgNO_3$, $CuCl_2$, $Mg(ClO_4)_2$, aluminum chloride, boron trifluoride, zinc chloride, nickel chloride, nickel bromide, nickel iodide, nickel acetylacetonate, palladium chloride, palladium bromide, palladium iodide, iron chloride, iron bromide, iron iodide, cobalt chloride, cobalt bromide and cobalt iodide, and the metal to be transported and deposited is at least one of copper, zinc, nickel, silver, magnesium, palladium, iron, aluminum, cobalt and boron.

2. The self-healing and adaptive shaped articles are in the form of layered composites comprising at least one solid electrolyte layer wherein the solid electrolyte layer comprises at least one solid electrolyte and at least one dissolved metal salt and the solid electrolyte layer has a thickness ranging from 1 nanometer to 5 millimeter and the solid electrolyte layer is bonded to a piezoelectric layer and, the piezoelectric layer has thickness ranging from 1 nanometer to 5 millimeter and;

at least one structural layer bonded to the piezoelectric layer with thickness ranging from 1 nanometer to 5 millimeter, and optionally, at least one of metal fillers and fibers incorporated into at least one of said layers;

wherein said piezoelectric materials comprise at least one of lead zirconate titanate ($Pb[Zr_xTi_{1-x}]O_3$ $0<x>1$) more commonly known as PZT, barium titanate ($BaTiO_3$), berlinite ($AlPO_4$), quartz ($SiO_2$), potassium sodium tartrate (KNaC4H406*4$H_2O$), topaz $Al_2SiO_4(F,OH)_2$, gallium orthophosphate ($GaPO_4$), Langasite ($La_3Ga_5SiO_{14}$), lead titanate ($PbTiO_3$), potassium niobate ($KNbO_3$), lithium niobate ($LiNbO_3$), lithium tantalate ($LiTaO_3$), sodium tungstate ($Na_2WO_3$), $Ba_2NaNb_5O_5$, $Pb_2KNb_5O_{15}$, polyvinylidene fluoride (PVDF), sodium potassium niobate ($(K, Na)NbO_3$) and bismuth ferrite ($BiFeO_3$);

wherein said solid electrolytes comprise at least one of poly(vinylidine fluoride-co-hexafluoropropylene), poly (vinylidine fluoride), polypyrrole, poly(ethylene oxide), poly(ethylene oxide methacrylate)-b-poly(lauryl methacrylate), Poly(propylene oxide), polyvinyl butyral, polyurethane, polystyrene sulfonate, poly(epichlorohydrin ethylene oxide), hydroxyethyl cellulose grafted with poly(ethylene oxide)diisocyanate, carboxymethylcellulose grafted with poly(ethylene oxide)diisocyanate, polypyrrole/polysulfide blends, polypyrrole/polyetherimide blends, polyaniline/polyaniline-sulfuric acid blends, perfluorinated polymers, sulfonated polyetheretherketone, poly(acrylonitrile), poly(acrylonitrile-co-methylmethacrylate), and polyethylene glycol and;

wherein said dissolved metal salts comprise at least one of copper(II) trifluoromethane sulfonate, $AgNO_3$, $CuCl_2$, $Mg(ClO_4)_2$, boron trifluoride, zinc chloride, nickel chloride, nickel bromide, nickel iodide, nickel acetylacetonate, palladium chloride, palladium bromide, palladium iodide, iron chloride, iron bromide, iron iodide, cobalt chloride, cobalt bromide and cobalt iodide, and the metal to be transported and deposited is at least one of copper, zinc, nickel, silver, magnesium, palladium, iron, aluminum, cobalt and boron.

3. The self-healing and adaptive shaped articles of claim 2, wherein the structural materials are made of at least one of polymer, ceramic, metal and carbon materials.

4. The self-healing and adaptive shaped articles of claim 2, wherein the optional metal fillers and fibers are made of at least one of copper, zinc, nickel, silver, magnesium, palladium, iron, aluminum, cobalt and boron, the optional metal fillers are particles with dimensions ranging from 1 nanometer to 5 millimeter, and the optional metal fibers have diameters ranging from 1 nanometer to 1 millimeter.

* * * * *